United States Patent [19]

Wu

[11] Patent Number: 4,561,648

[45] Date of Patent: Dec. 31, 1985

[54] EXERCISING DEVICE

[76] Inventor: Shih-Jang Wu, 12 F-1, No. 303 Tung Hua N. Rd., Taipei, Taiwan

[21] Appl. No.: 651,956

[22] Filed: Sep. 19, 1984

[51] Int. Cl.[4] ..... A63B 21/00; A63B 21/22; A63B 23/04; A63B 69/16

[52] U.S. Cl. ..... 272/73; 272/132

[58] Field of Search ..... 272/73, 132; 280/220, 280/221, 229; 434/61, 247

[56] References Cited

U.S. PATENT DOCUMENTS

| | | | |
|---|---|---|---|
| 499,009 | 6/1893 | Bunker | 280/229 |
| 3,905,597 | 9/1975 | Tabb | 272/73 |
| 3,940,128 | 2/1976 | Ragone | 272/73 |
| 4,201,396 | 5/1980 | Gessi | 280/229 |
| 4,212,480 | 7/1980 | Mikina et al. | 280/220 |

FOREIGN PATENT DOCUMENTS

| | | | |
|---|---|---|---|
| 0658555 | 6/1929 | France | 280/229 |
| 0803740 | 10/1936 | France | 280/221 |

*Primary Examiner*—Richard J. Apley
*Assistant Examiner*—Kathleen D'Arrigo
*Attorney, Agent, or Firm*—Bacon & Thomas

[57] ABSTRACT

The present invention relates to an exercising device and more particularly to one substantially comprising a bicycle frame, a rear wheel, two driven wheels a chain drive arrangement and a base frame wherein the rear wheel is rotatively mounted at the rear end of the bicycle frame; the base frame supports the bicycle frame in a manner such that the rear wheel may rest on the two driven wheels. The major feature of the present invention is that the hub of the rear wheel is eccentrically disposed whereby the saddle of the bicycle frame may perform up-and-down motion while the chain drive arrangement is driven by a rider of the exercising device.

1 Claim, 2 Drawing Figures

EXERCISING DEVICE

BACKGROUND OF THE INVENTION

Exercising devices of the type having a bicycle frame been mounted on a base frame have been seen for many years. Generally, such conventional exercising devices comprise a bicycle frame which is supported by a base frame whereby an exerciser of such exercising devices may simulate a riding exercise. However, the hubs of the front and rear wheels of such conventional exercising devices are usually centrally disposed such that the rider of such exercising devices can only simulate a dry and boring riding exercise and thus obtain the exercise in the leg muscles.

SUMMARY OF THE INVENTION

The major object of the present invention is to provide an improved exercising device comprising a bicycle frame supported by a base frame in which the hub of the rear wheel of the bicycle frame is eccentrically disposed such that the rider of the exercising device may carry out an up-and-down motion in addition to a riding exercise during riding of such exercising device.

These and other objects and features of the present invention will become apparent from the following detailed description of a preferred embodiment according to the present invention in conjunction with the accompanying drawings.

DETAILED DESCRIPTION OF THE PREFERRED EMBODIMENT

Figure 1:
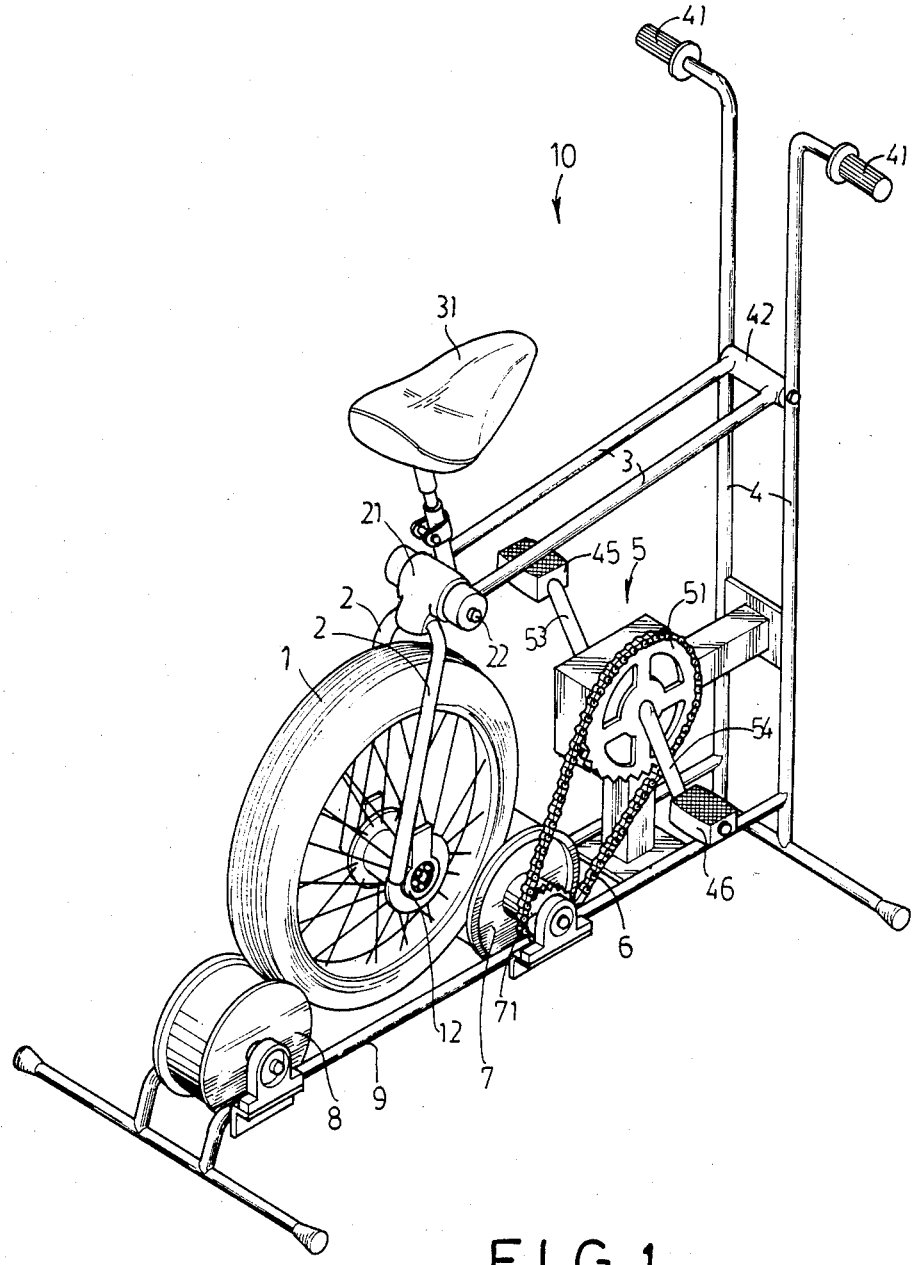
FIG. 1 is a perspective view of an improved exercising device according to the present invention.

Referring now to the drawings, FIG. 1 illustrates an exercising device according to the present invention. Such exercising device mainly comprises a bicycle frame (10), a rear wheel (1), two driven wheels (7,8), a chain drive arrangement (5) and a base frame (9). As shown in FIG. 1, the rear wheel (1) is rotatively mounted at the rear end of the bicycle frame (1), and is disposed in frictionally contacted relationship to the driven wheels (7,8). The chain drive arrangement (5) comprises two cranks (53, 54), two pedals (45, 46), a chain wheel (51), a chain (6) and a sprocket wheel (71). Note that the sprocket wheel (71) of the chain drive arrangement (5) is connected to, and is coaxial with the front driven wheel (7) such that the front driven wheel (7) may be driven by the chain drive arrangement (5).

One feature of the present ivnention is that a ball-bearing hub (12) is eccentrically disposed at the rear wheel (1). Another feature of the present invention is that the bicycle frame (10) of the present invention is mainly consisted of two front forks (4), two top tubes (3), a connector (21) and two rear forks (2) wherein each of the rear forks (2) is connected between the eccentric ball-bearing hub (12) and the connector (21), and one end of each top tube (3) is pivotally connected to a sleeve bearing (42) which is fixed between the front forks (4). Furthermore, the other end of each top tube (3) is connected and aligned with the connector (21) by means of an axis (22) such that the connector (21) together with the rear forks (2) may be rotated about the axis (22) relative to the other ends of the top tubes (3). As shown in FIG. 1, the bicycle frame (10) of the invention further comprises a saddle (31) connected to the connector (21), and two grips (41) disposed at the upper end of each front forks (4).

The front and rear driven wheels (7, 8) are rotatively mounted on the support frame (9). Each of the front and rear driven wheels (7, 8) is substantially a cylindrical body having a rim formed radially at the both surfaces for preventing the rear wheel from deviation during rotation.

In operation, as a rider seated on the saddle (31) actuates the pedals (45, 46) of the chain drive arrangement (5) along clockwise direction, the front driven wheel (7) will also rotate along clockwise direction, and thus the rear wheel (1) will rotate along counterclockwise direction due to the frictional drag between the rear wheel (1) and the front driven wheel (7). Further, the rear driven wheel (8) driven by the rear wheel (1) is provided for fitting the rear wheel (1).

Figure 2:
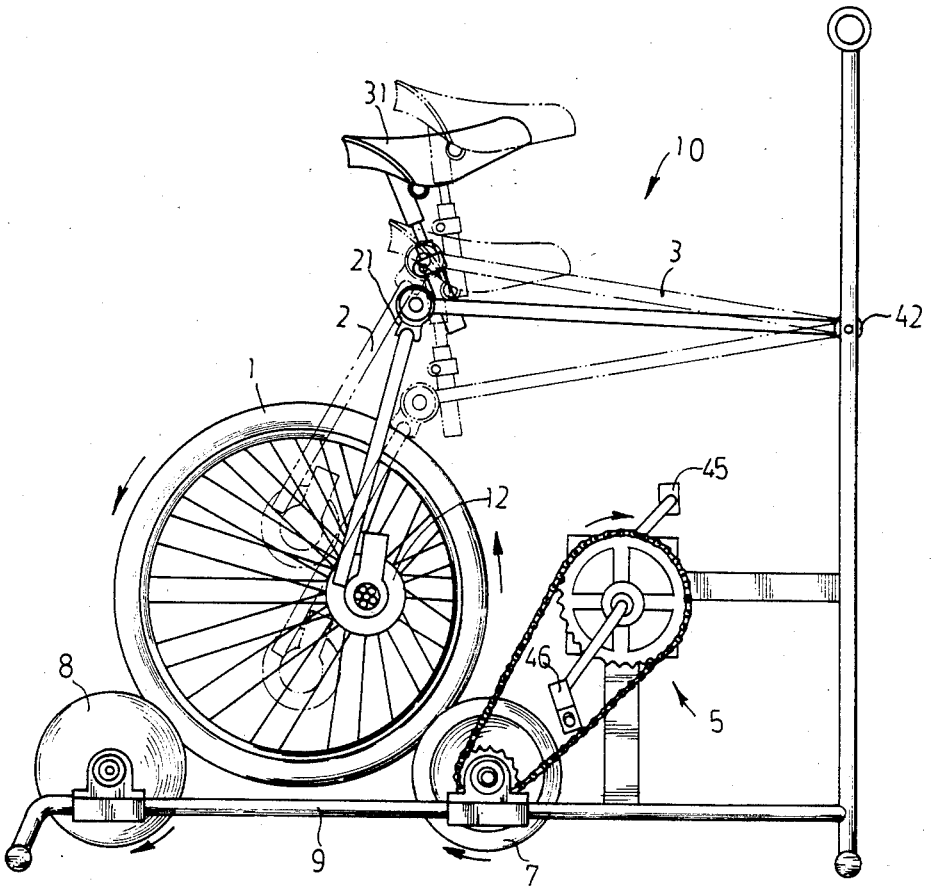
FIG. 2 is a side elevational view of the exercising device of FIG. 1, in which various positions of the saddle of the bicycle frame are shown in solid and broken lines.

When the rear wheel (1) is rotated by actuating the chain drive arrangement (5), the rear forks (2) connected to the eccentric hub (12) will cause the connector (21) together with the saddle (31) to move along a segmental path which is substantially a segment of an imaginary circle about the bearing sleeve (42) with its radius equivalent to the length of the top tubes (3), as shown in FIG. 2. Accordingly, the rider of the exercising device according to the present invention may simulate a riding motion and further make an up-and-down motion during riding the exercising device.

It is noted that the exercising device in accordance with the present invention is characterized in that a hub is eccentrically disposed at the rear wheel, and the top tubes of the bicycle frame is pivotally connected to the connector at one end which is connected with the rear forks, and at the other end, is pivotally connected to a sleeve bearing which is connected with the front forks. However, although the exercising device of the present invention is described in conjunction with the accompanying drawings and the embodiment shown in such drawings, it is apparent to those skilled in the art that various modifications and variations may also made without departing from the spirit and scope of the invention and the following claim.

I claim:

1. An exercising device comprisng:

a bicycle frame;

a rear wheel rotatively mounted at the rear end of said bicycle frame, front and rear driven wheels;

a base frame supporting said bicycle frame and said driven wheels in such a manner that said rear wheel is rested on said driven wheels; and chain drive means operatively connected to the front driven wheel for rotating said rear wheel;

characterized in that said bicycle frame includes two top tubes, one end of each is pivotally connected to a sleeve bearing which is fitted between two front forks of said bicycle frame; the other end of each of said top tubes is pivotally connected with a connector which is fitted with two rear forks of said bicycle frame, and said rear forks are connected to an eccentrically disposed hub of said rear wheel, such that a rider of said exercising device may simulate a riding motion and further carry out an up-and-down motion when riding said exercising device.

* * * * *